US007581768B2

(12) United States Patent
Balbo Di Vinadio

(10) Patent No.: US 7,581,768 B2
(45) Date of Patent: Sep. 1, 2009

(54) ANTI-EFFRACTION SAFETY SYSTEM FOR DOOR AND WINDOW FRAMES

(75) Inventor: Aimone Balbo Di Vinadio, Chiusa San Michele (IT)

(73) Assignee: Savio S.p.A., Turin (IT)

( * ) Notice: Subject to any disclaimer, the term of this patent is extended or adjusted under 35 U.S.C. 154(b) by 0 days.

(21) Appl. No.: 12/045,614

(22) Filed: Mar. 10, 2008

(65) Prior Publication Data

US 2009/0113825 A1 May 7, 2009

(30) Foreign Application Priority Data

Nov. 5, 2007 (IT) ..... TO2007A0780

(51) Int. Cl.
*E05C 19/18* (2006.01)

(52) U.S. Cl. ..... 292/288; 49/394; 49/395; 49/400; 292/DIG. 46; 292/289; 292/300; 292/259 R; 292/302; 292/8; 292/29; 292/131; 292/171; 292/175; 292/146; 292/150; 292/32; 292/38; 292/42; 292/DIG. 33; 16/382

(58) Field of Classification Search ..... 292/288–300, 292/245 R, 302, 8, 29, 32, 38, 42, 137, 171, 292/175, 146, 150, 336.3, DIG. 33, DIG. 46; 49/394, 395, 400; 16/382
See application file for complete search history.

(56) References Cited

U.S. PATENT DOCUMENTS 2,898,991 A * 8/1959 Kelly et al. ..... 160/369
4,379,576 A * 4/1983 Blough et al. ..... 292/205
4,530,531 A * 7/1985 Mantini ..... 292/302
4,635,396 A * 1/1987 Ranz et al. ..... 49/141
5,314,218 A * 5/1994 Nadherny ..... 292/256.5
5,454,610 A * 10/1995 Taylor et al. ..... 292/339

(Continued)

FOREIGN PATENT DOCUMENTS

CH 673134 2/1990

(Continued)

OTHER PUBLICATIONS

EP Search Report, Application No. 08152204.7-2311, dated Apr. 16, 2009.

*Primary Examiner*—Jerry Redman
*Assistant Examiner*—Jeff Tang
(74) *Attorney, Agent, or Firm*—Patterson & Sheridan, L.L.P.

(57) ABSTRACT

An anti-effraction safety system for a door or window frame comprising a fixed frame and a mobile frame, in which the mobile frame comprises at least one sectional element with a longitudinal groove with two undercut portions set on opposite sides of a longitudinal central opening and in which at least one transmission rod slidably engages said groove and can be displaced in a longitudinal direction by means of a control handle. Fixed to the transmission rod is at least one closing element co-operating with a complementary detent fixed to the fixed frame. The transmission rod has two through openings both open on respective longitudinal edges of the rod. The closing element comprises two separate complementary parts fixed to one another, in which each of said separate parts engages a respective through opening of the transmission rod and has a respective tenon that slidably engages in a longitudinal direction a respective undercut portion of the groove.

5 Claims, 14 Drawing Sheets

U.S. PATENT DOCUMENTS

| | | | | |
|---|---|---|---|---|
| 5,664,814 | A * | 9/1997 | Lin | 292/288 |
| 6,050,621 | A * | 4/2000 | Martinez et al. | 292/289 |
| 6,073,978 | A * | 6/2000 | Sherman | 292/80 |
| 6,612,625 | B1 * | 9/2003 | Barber et al. | 292/87 |
| 6,712,404 | B2 * | 3/2004 | Davies et al. | 292/87 |
| 7,216,902 | B2 * | 5/2007 | Marra et al. | 292/288 |
| 7,219,469 | B2 * | 5/2007 | DiFrancesco | 49/395 |
| 7,353,637 | B2 * | 4/2008 | Harger et al. | 49/449 |
| 2004/0144033 | A1 * | 7/2004 | Annes | 49/394 |
| 2005/0046201 | A1 * | 3/2005 | Patire et al. | 292/289 |
| 2008/0060274 | A1 * | 3/2008 | Vooght | 49/394 |

FOREIGN PATENT DOCUMENTS

| | | |
|---|---|---|
| DE | 20 2005 013 427 | 11/2005 |
| EP | 1 867 821 | 12/2007 |
| EP | 1 867 824 | 12/2007 |

* cited by examiner

ANTI-EFFRACTION SAFETY SYSTEM FOR DOOR AND WINDOW FRAMES

CROSS-REFERENCE TO RELATED APPLICATIONS

This application claims benefit of Italian patent application serial number TO2007A000780, filed Nov. 5, 2007, which is herein incorporated by reference.

BACKGROUND OF THE INVENTION

1. Field of the Invention

The present invention relates to an anti-effraction safety system for door and window frames.

The invention has been developed in particular with a view to its application to door and window frames formed by a fixed frame and a mobile frame and constituted by sectional elements made of light alloy, typically aluminium or its alloys. In this type of door and window frames, the sectional elements forming the mobile frame are provided with at least one longitudinal groove with undercut cross section, installed within which are the accessories that enable control of opening and closing of the door or window frame according to the position of a control handle. Said accessories comprise one or more closing elements, which co-operate with complementary closing elements fixed to the fixed frame.

2. Description of the Related Art

An example of door and window frames of this type is described in the European patent application No. 07108493 filed in the name of the present applicant.

Attempts at effraction in regard to door and window frames of this type are usually performed by trying to deform inwards the upright of the mobile frame opposite to the hinges. In order to carry out an attempt at effraction of this type, an effraction tool is forced into the space between the sectional element of the mobile frame and the corresponding sectional element of the fixed frame. Said tool is then rotated so as to deform the sectional element of the mobile frame inwards.

SUMMARY OF THE INVENTION

The object of the present invention is to provide a safety system that will counteract effectively any attempts at breaking in of this type and that at the same time will enable simple and fast installation thereof.

According to the present invention, said object is achieved by an anti-effraction safety system having the characteristics forming the subject of claim 1.

BRIEF DESCRIPTION OF THE DRAWINGS

The characteristics and advantages of the present invention will emerge clearly in the course of the detailed description which follows, provided purely by way of non-limiting example, with reference to the attached drawings in which.

DETAILED DESCRIPTION

Figure 1:
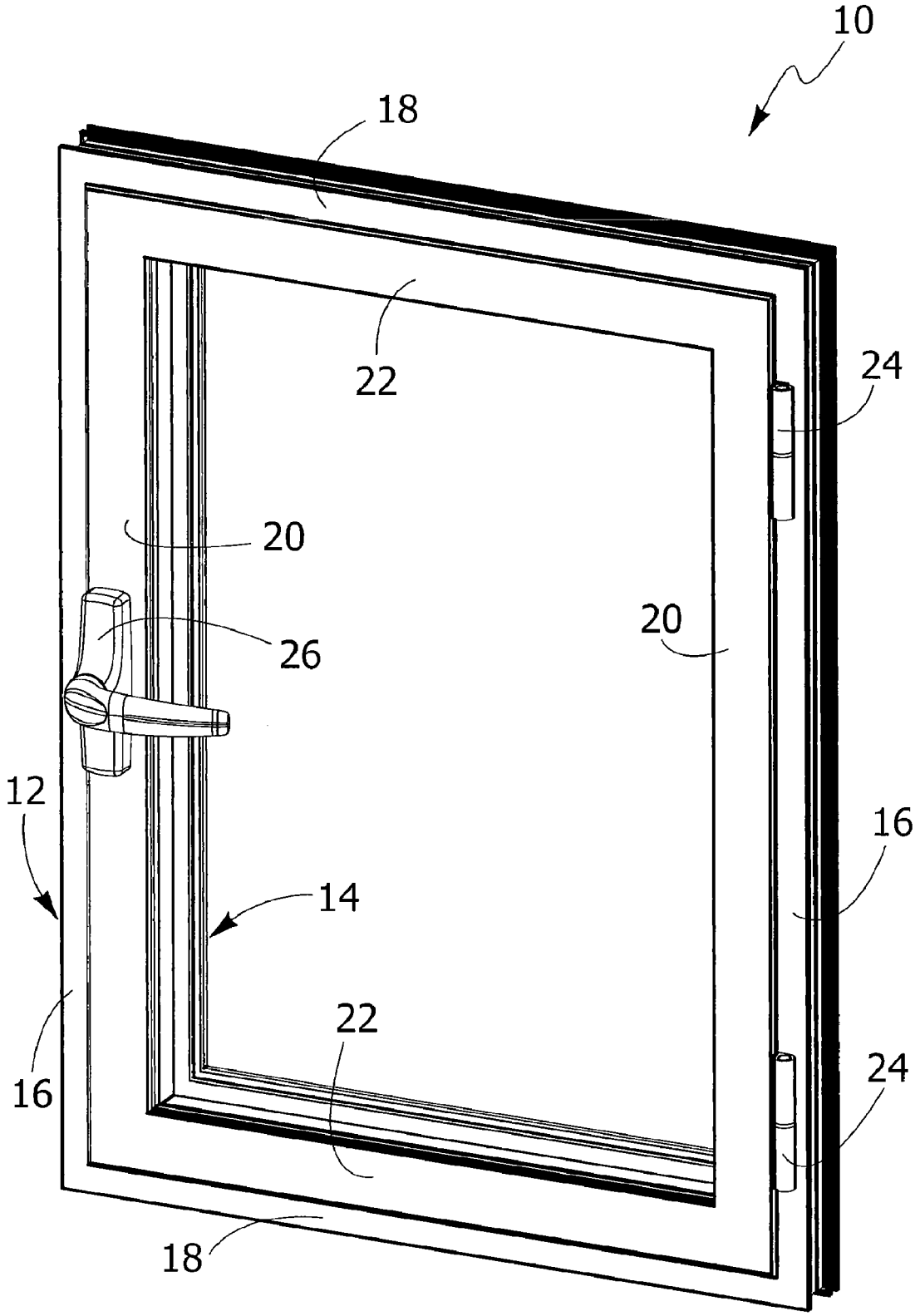
FIG. 1 is a perspective view of a door or window frame on which a safety system according to the present invention can be applied.

With reference to FIG. 1, designated by 10 is a door or window frame comprising a fixed frame 12 and a mobile frame 14. The fixed frame is formed by two uprights 16 and by two cross members 18. The mobile frame 14 comprises two uprights 20, parallel to the uprights 16 of the fixed frame 12, and two cross members 22, parallel to the cross members 18 of the fixed frame 12. In the example illustrated in the figures, the mobile frame 14 is articulated to the fixed frame 12 by means of a pair of hinges 24, which define a vertical axis of rotation. The present invention may be applied also to door and window frames with opening of a different type, for example, in which the frame 18 can be opened with a movement of rotation about a horizontal axis (transom-window-type opening) or else to door and window frames that can be opened with rotation both about a vertical axis (leaf opening) and about a horizontal axis (transom-window-type opening). The mobile frame 14 is provided with a control handle 26 mounted on an upright 20 opposite to the upright carrying the hinges 24. The handle 26 controls, in a known way, the movement of transmission elements that enable selection of the positions of opening or closing or else of leaf opening, transom-window-type opening, and closing.

The uprights and the cross members 16, 18, 20, 22 of the fixed frame 12 and of the mobile frame 14 are constituted by metal sectional elements, typically made of aluminium or its alloys.

Figure 2:
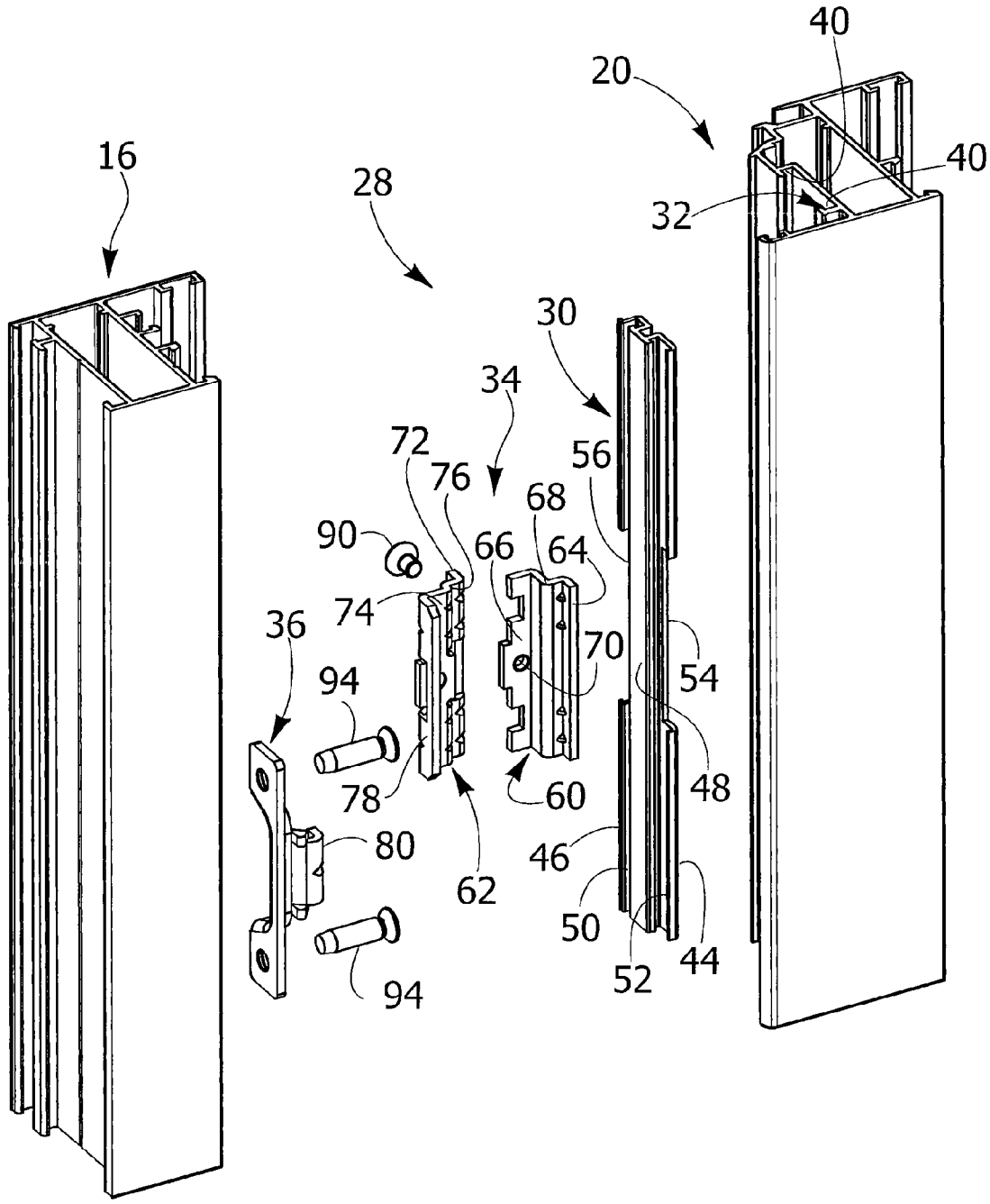
FIG. 2 is an exploded perspective view of the anti-effraction safety system according to the present invention.

With reference to FIG. 2, designated by 28 is an anti-effraction safety system according to the present invention. The system 28 comprises a transmission rod 30, which slidably engages a longitudinal groove 32 provided on the sectional element forming one of the uprights 20 or one of the cross members 22 of the mobile frame 14. More precisely, the transmission rod 30 is mounted in the groove 32 of the sectional element 20, 22 on which the control handle 26 is fixed.

The anti-effraction system 28 comprises a closing element 34, which is fixed on the transmission rod 30 in the way that will be described in what follows, and a detent 36 complementary with respect to the closing element 34 and fixed to the corresponding upright 16 or cross member 18 of the fixed frame 12.

Figure 4:
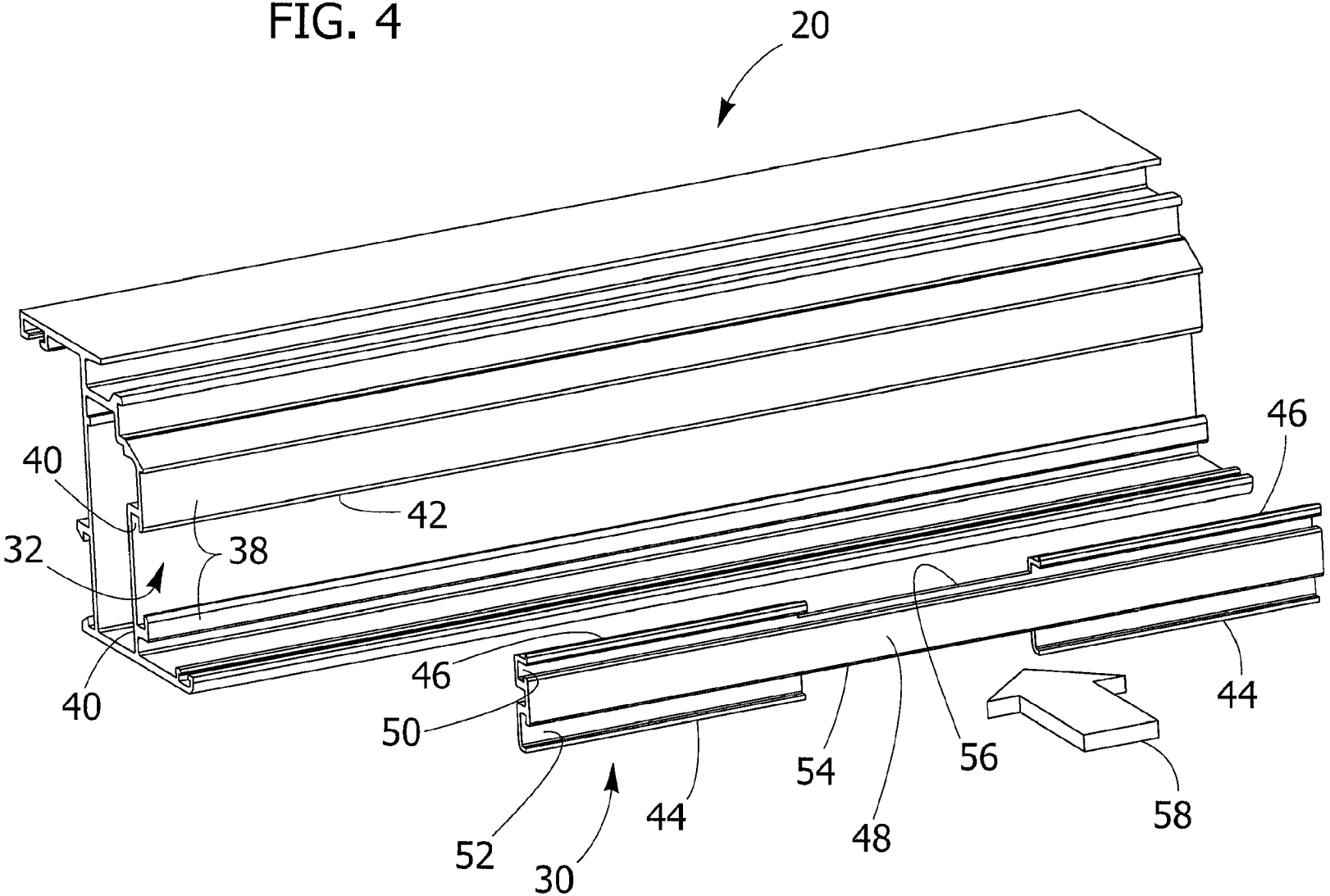

With reference, in particular, to FIG. 4, the sectional elements forming the mobile frame 14 are made in a conventional way by means of techniques of extrusion, drawing, or the like. In a conventional way, the metal sectional elements for door and window frames are provided with at least one groove 32 with undercut cross section for installation of the accessories of the door or window frame. The groove 32 has two opposed longitudinal edges 38 that define respective undercut portions 40. The two opposed edges 38 define an opening 42 elongated in a longitudinal direction.

Figure 3:
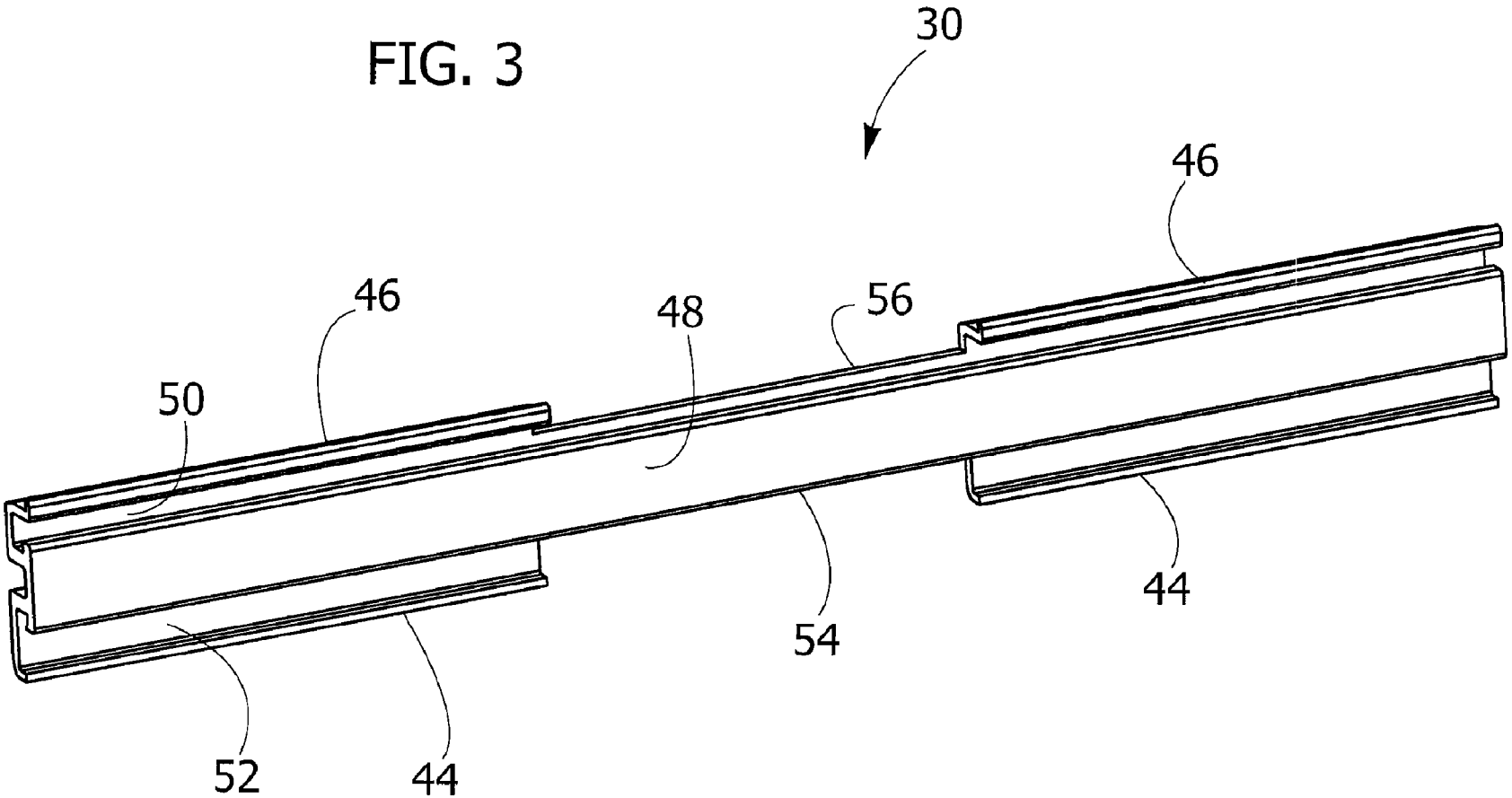
FIGS. 3-13 illustrate the sequence of installation of the safety system according to the present invention.
Figure 5:
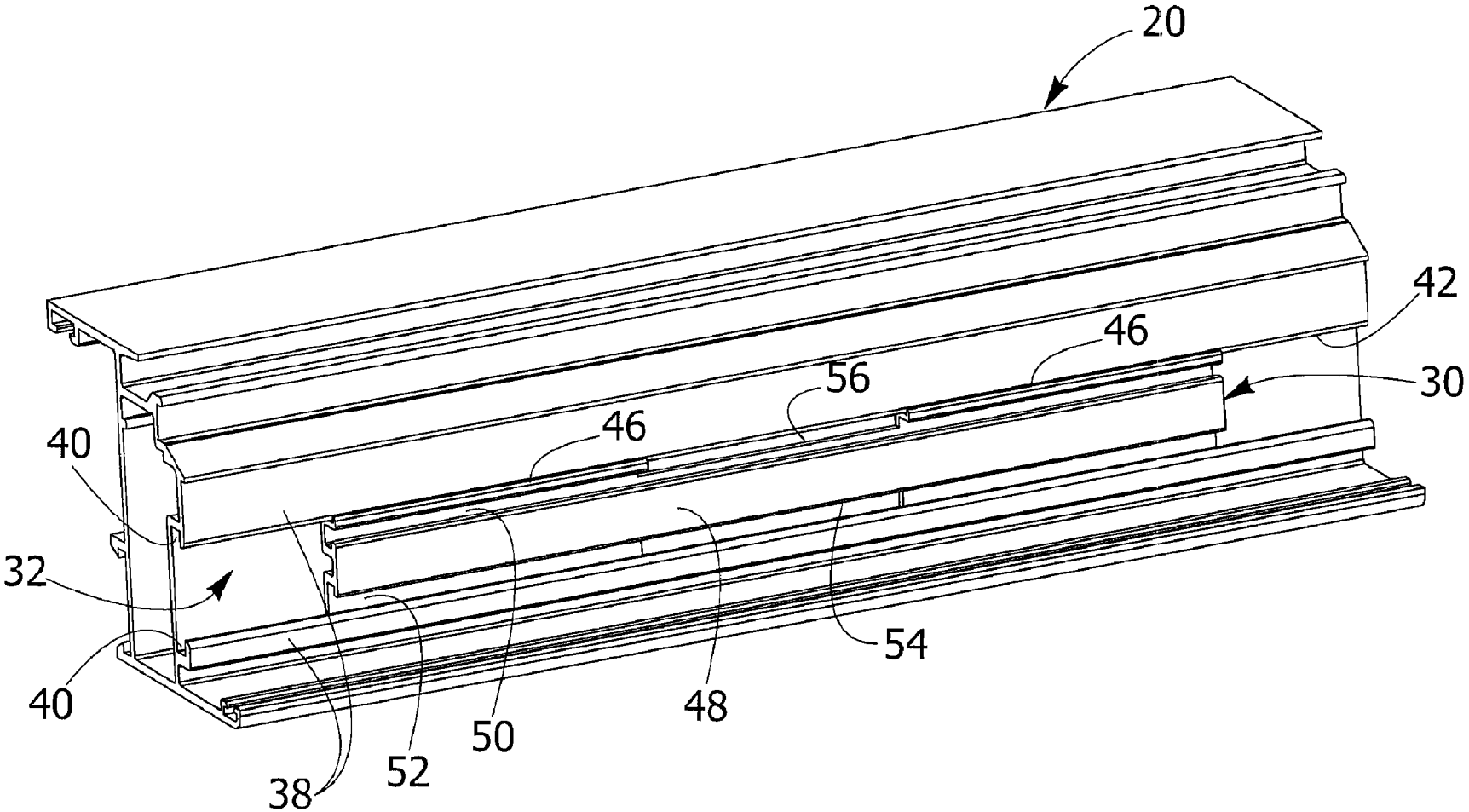

With reference to FIGS. 3-5 the transmission rod 30 is shaped so as to engage slidably in a longitudinal direction the groove 32. Preferably, the transmission rod 30 is made as described in the European patent applications No. 06425583 and 06425586 filed in the name of the present applicant. The transmission rod 30 comprises a longitudinal tenon 44, which engages one of the undercut portions 40 of the groove 42. On the longitudinal edge opposite to the tenon 44, the transmission rod 30 has a longitudinal edge 46, which rests on the outer side of the corresponding edge 38 of the groove 32. The transmission rod 30 has a longitudinal plane surface 48 and two longitudinal grooves 50, 52, which extend on opposite sides with respect to the plane surface 48. The functions of the plane surface 48 and of the longitudinal grooves 50, 52 are described in detail in the European patent application No. 06425583, already cited previously.

The transmission rod 30 is moreover provided with two opposed through openings 54, 56, both open on the respective longitudinal edges of the rod 30. The openings 54, 56 are set on opposite sides with respect to the longitudinal plane surface 48. The transmission rod 30 is inserted into the groove 32 of the sectional element 20 in the direction indicated by the arrow 58 in FIG. 4, i.e., in the orthogonal direction with respect to the opening 42. FIG. 5 shows the transmission rod 30 inserted into the groove 32. As may be noted, in the configuration in which the transmission rod 30 is mounted in the longitudinal groove 32, two through openings are defined between the edges 38 of the groove 32 and the corresponding edges of the through openings 54, 56.

With reference to FIGS. 2 and 6-13, the closing element 34 is formed by two separate and complementary parts 60, 62, fixed to one another in the way that will be described in what follows. The two parts 60, 62 are formed so as to be inserted separately into the groove 32 when the transmission rod 30 has already been inserted into the groove 32. Each of the two parts 60, 62 is inserted through a respective through opening 54, 56 and engages the respective undercut portion 40 of the groove 32. The length of the two parts 60, 62 of the closing element 34 is substantially the same as the length of the through openings 54, 56 of the transmission rod 30. Each of the two parts 60, 62 of the closing element 34 is constituted by a monolithic piece of metal plate, for example steel, either bent or stamped. The first part 60 comprises a tenon 64, a fixing portion 66, and an intermediate connection portion 68. The fixing portion 66 is provided with a threaded hole 70. The second part 62 also comprises a tenon 72, a fixing portion 74, and an intermediate portion 76. The second part 62 further comprises an edge 78, which is bent at 900 with respect to the fixing portion 74 and forms a portion of engagement with a corresponding engagement portion 80 of the detent 36 (FIG. 2).

Figure 6:
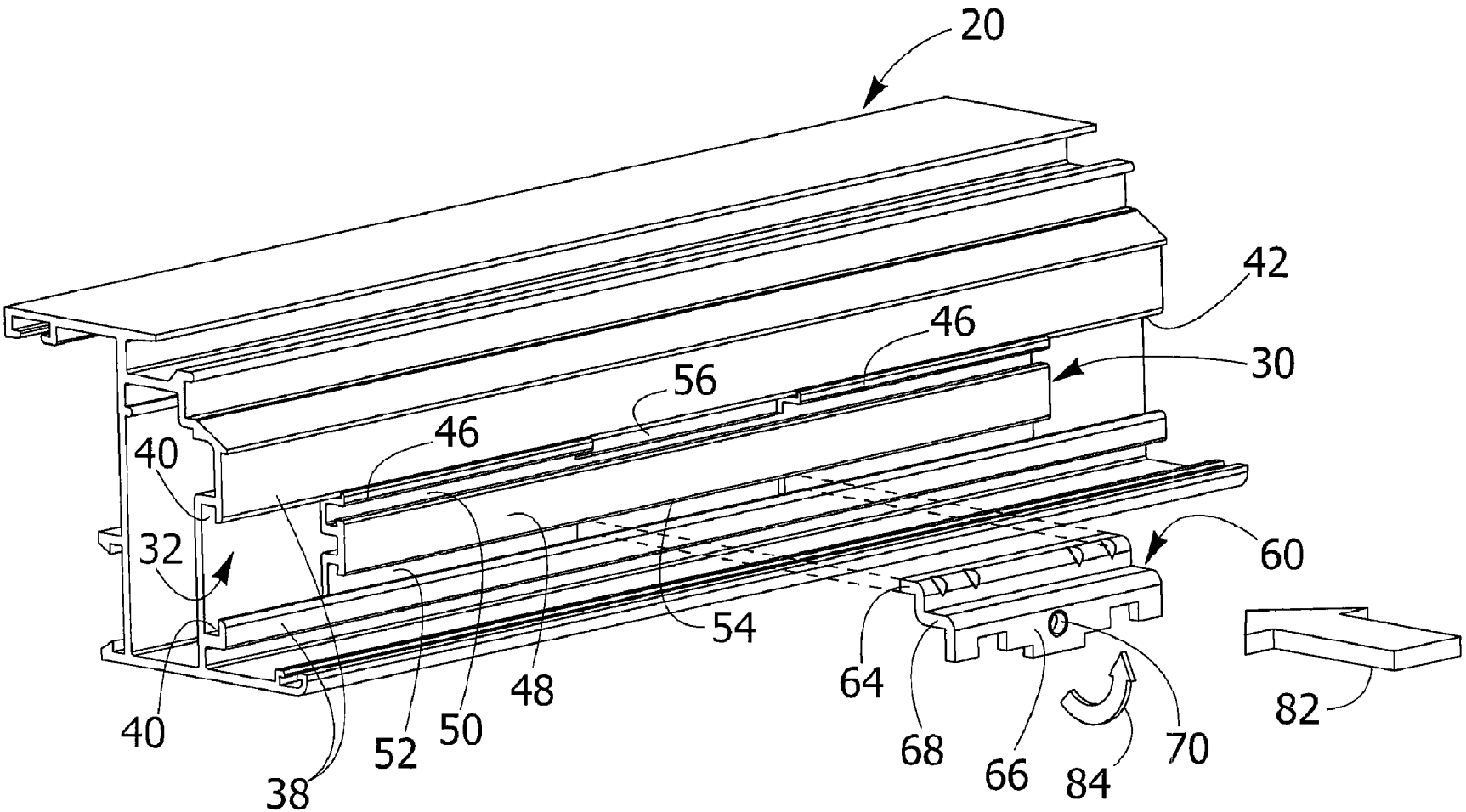
Figure 7:
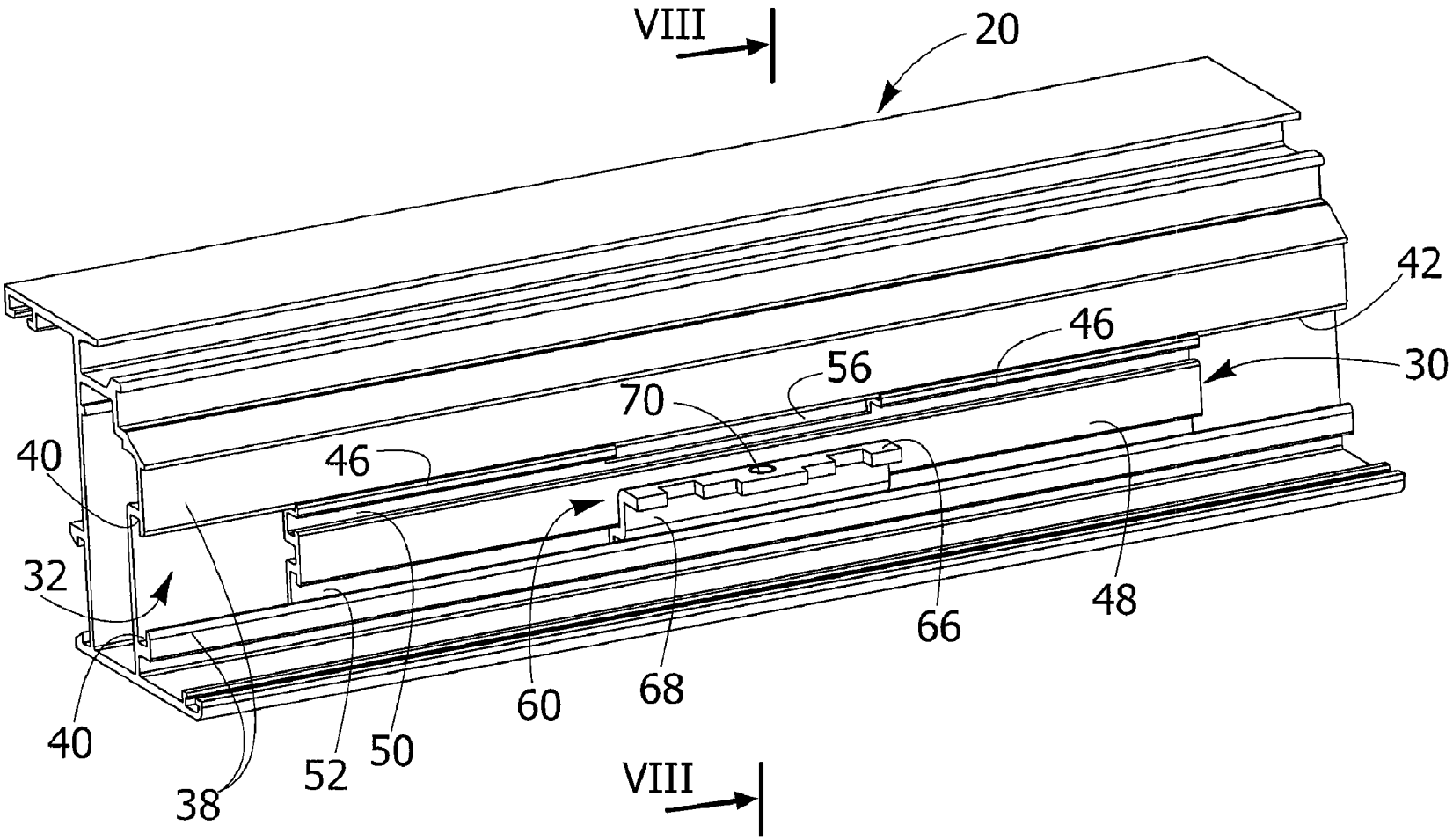
Figure 8:
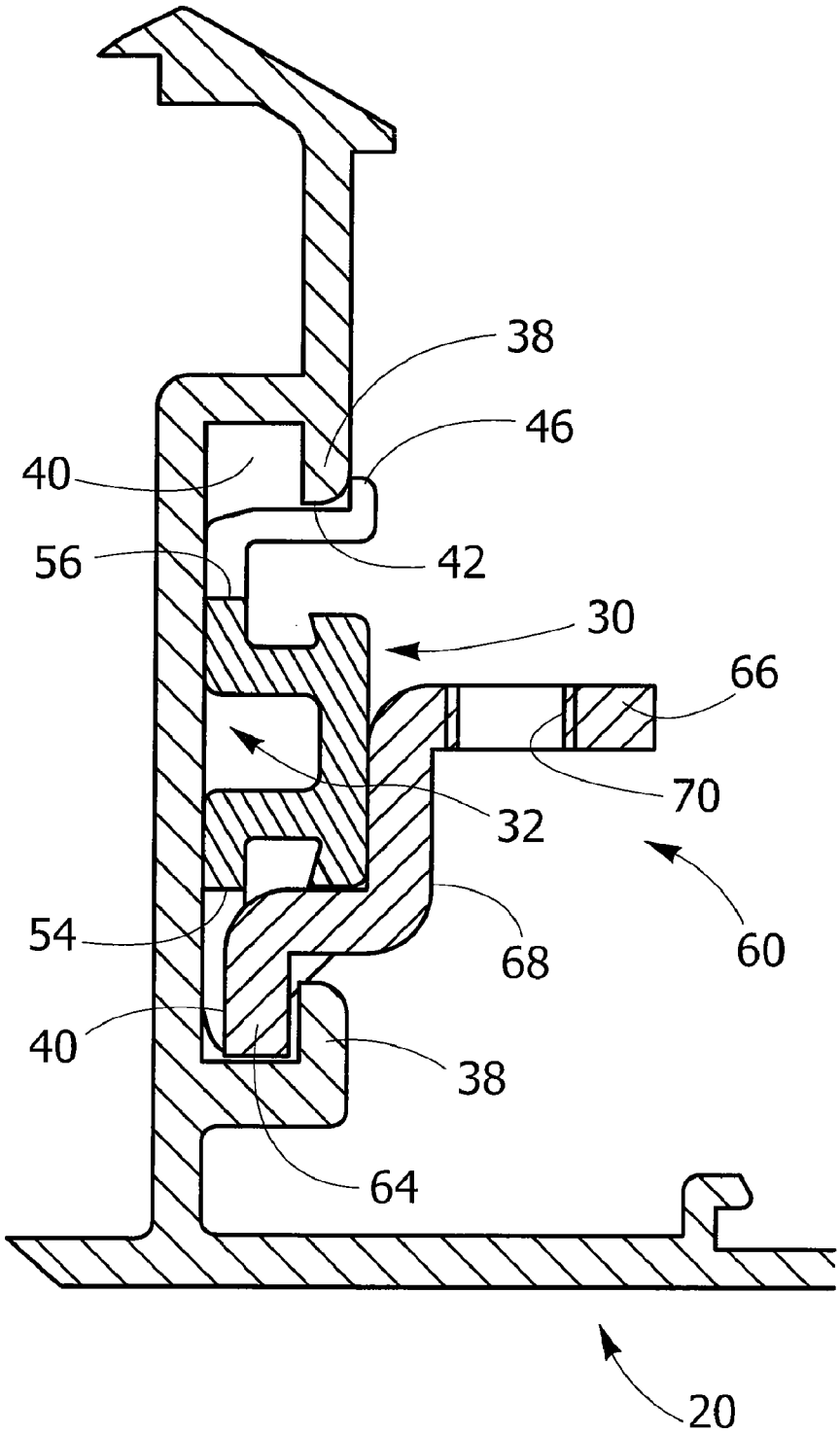

Installation of the closing element 34 is performed according to the sequence illustrated in FIGS. 6-12. With reference to FIG. 6, after insertion of the transmission rod 30 into the groove 42 as described previously, the first part 60 of the closing element 34 is inserted inside the groove 32 through the opening 54. The first part 60 is inserted in the direction indicated by the arrow 82 in FIG. 6, with the tenon 64 oriented towards the opening 42 and set in a position corresponding to the opening 54 of the rod 30. After insertion of the tenon 64 into the groove 32, the first part 60 is rotated in the direction indicated by the arrow 84 in FIG. 6. Following upon said rotation, the first part 60 is positioned as illustrated in FIGS. 7 and 8.

Figure 9:
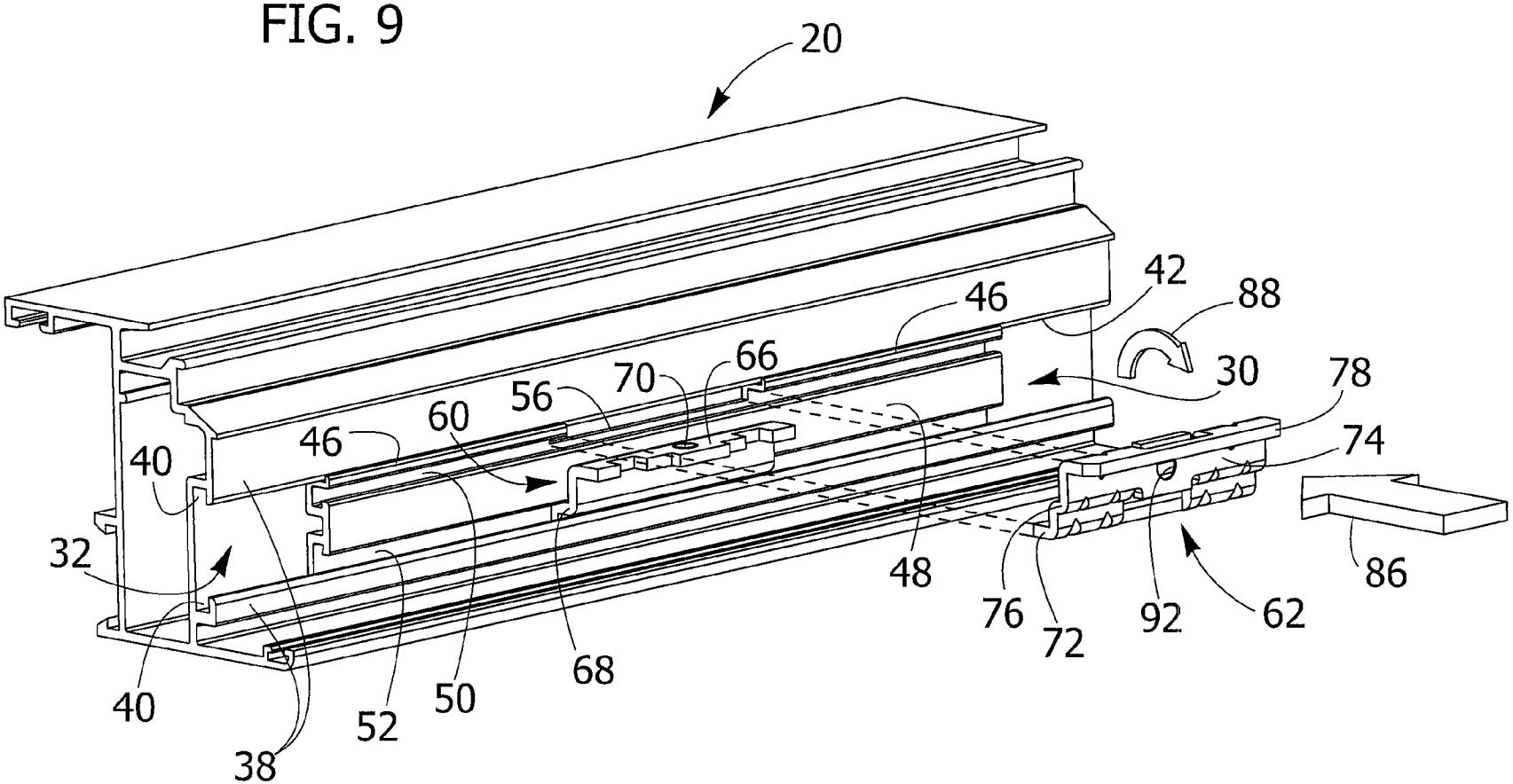
Figure 10:
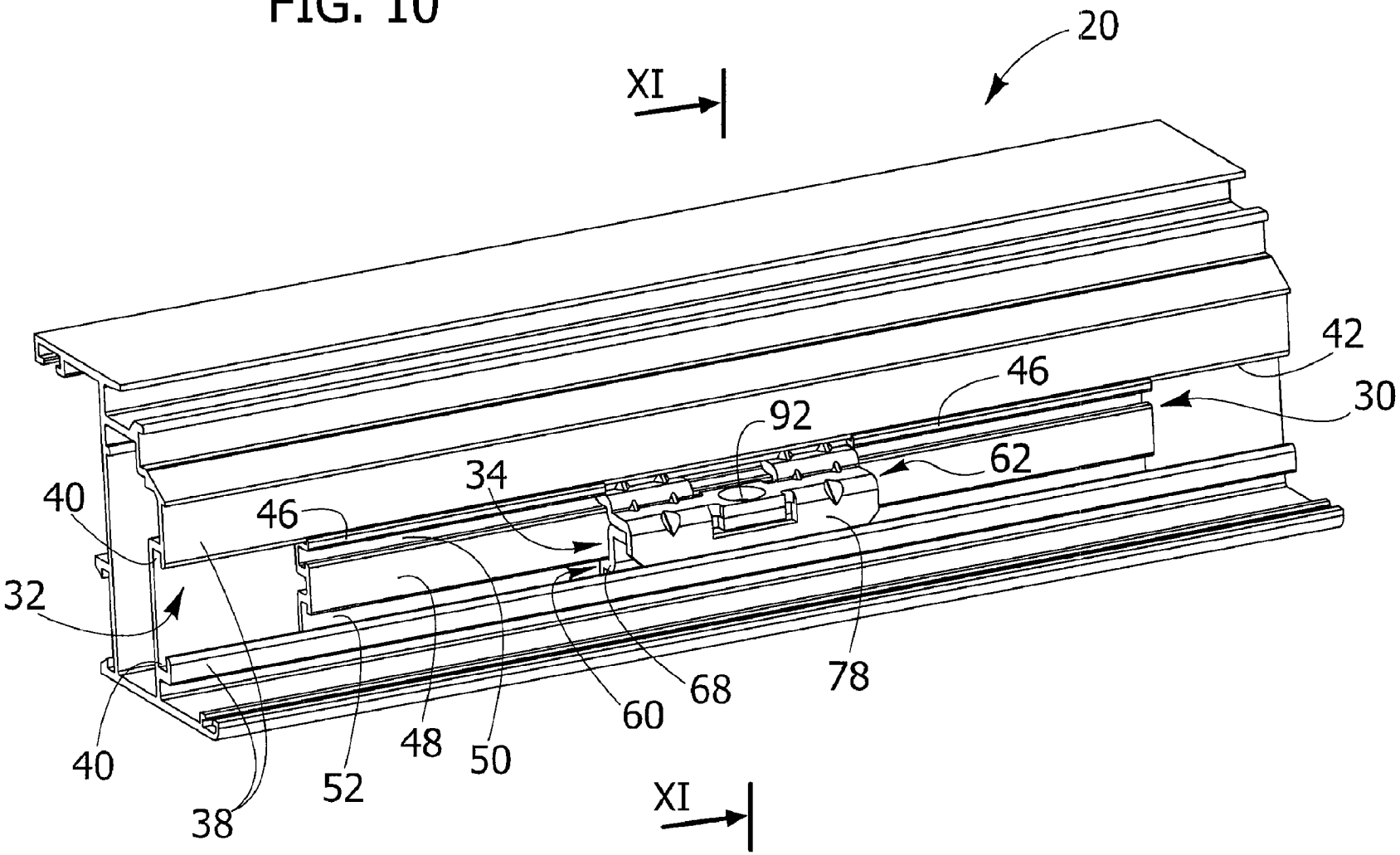

Then the second part 62 is mounted, as illustrated in FIG. 9. The second part 62 is inserted into the groove 32 in the direction indicated by the arrow 86 with the tenon 72 facing the opening 42 and set in a position corresponding to the opening 56 of the rod 30. Next, the second part 62 is rotated in the direction indicated by the arrow 88. At this point, the closing element assumes the configuration illustrated in FIGS. 10 and 11.

Figure 11:
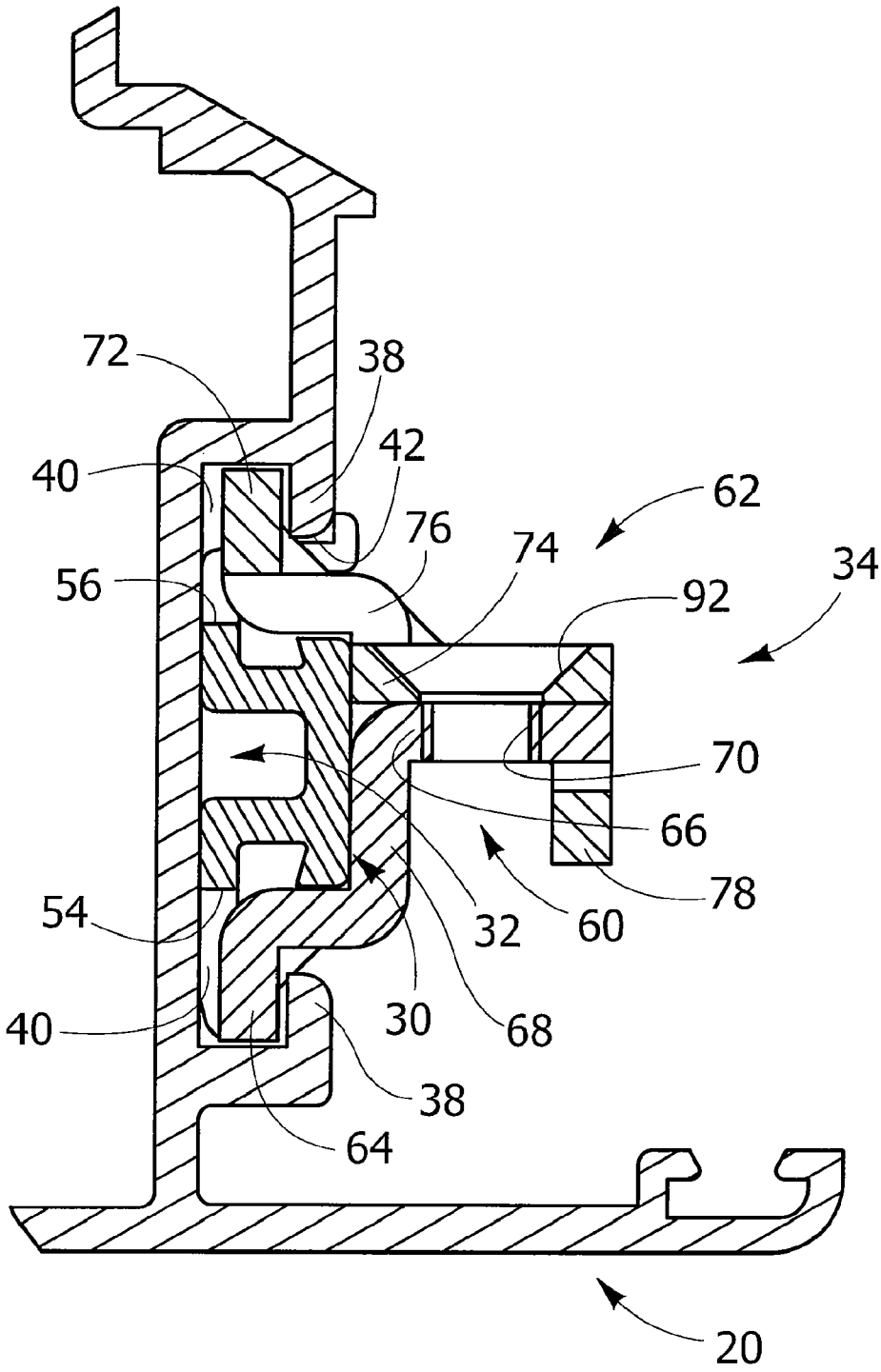
Figure 12:
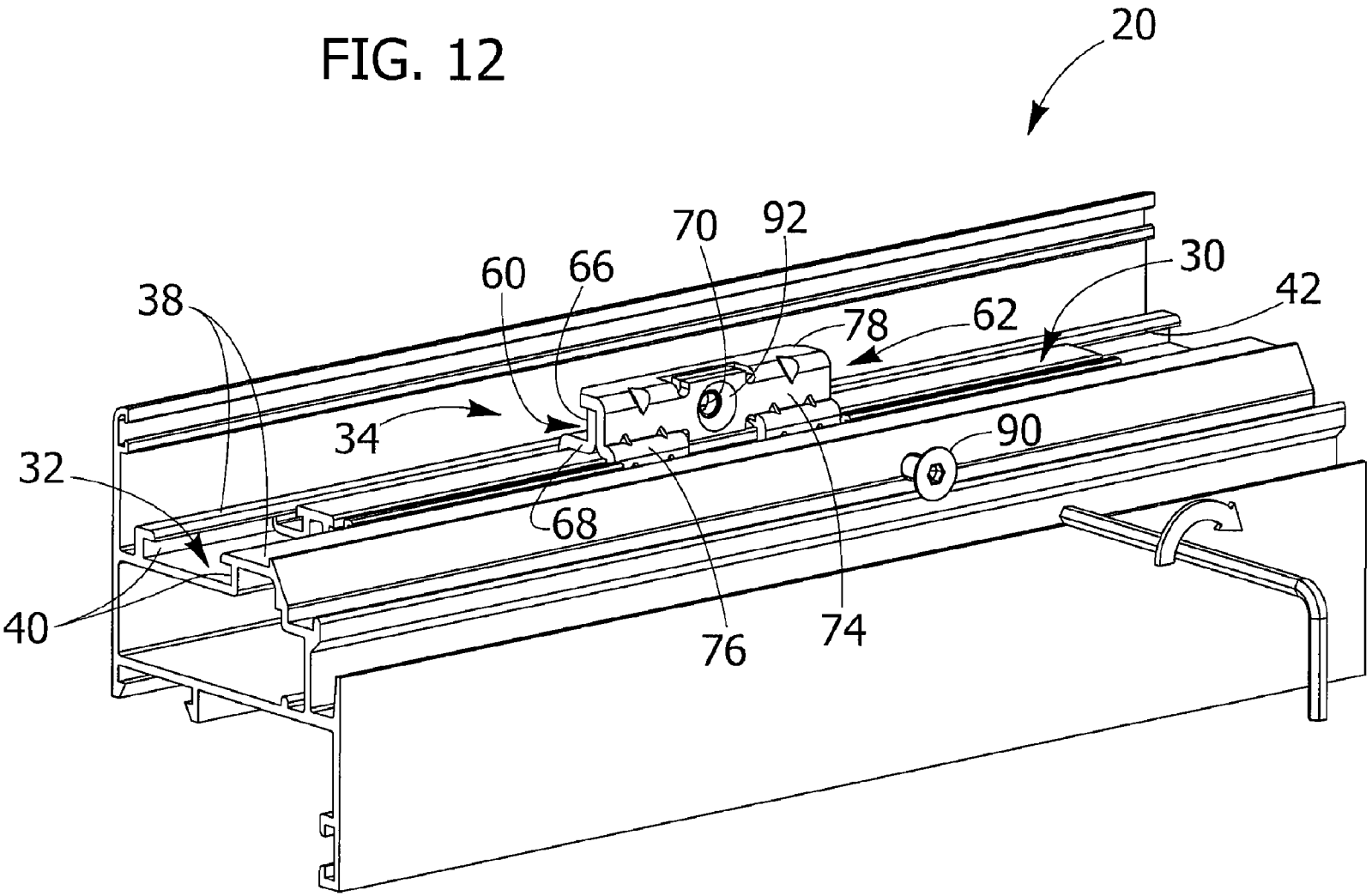
Figure 13:
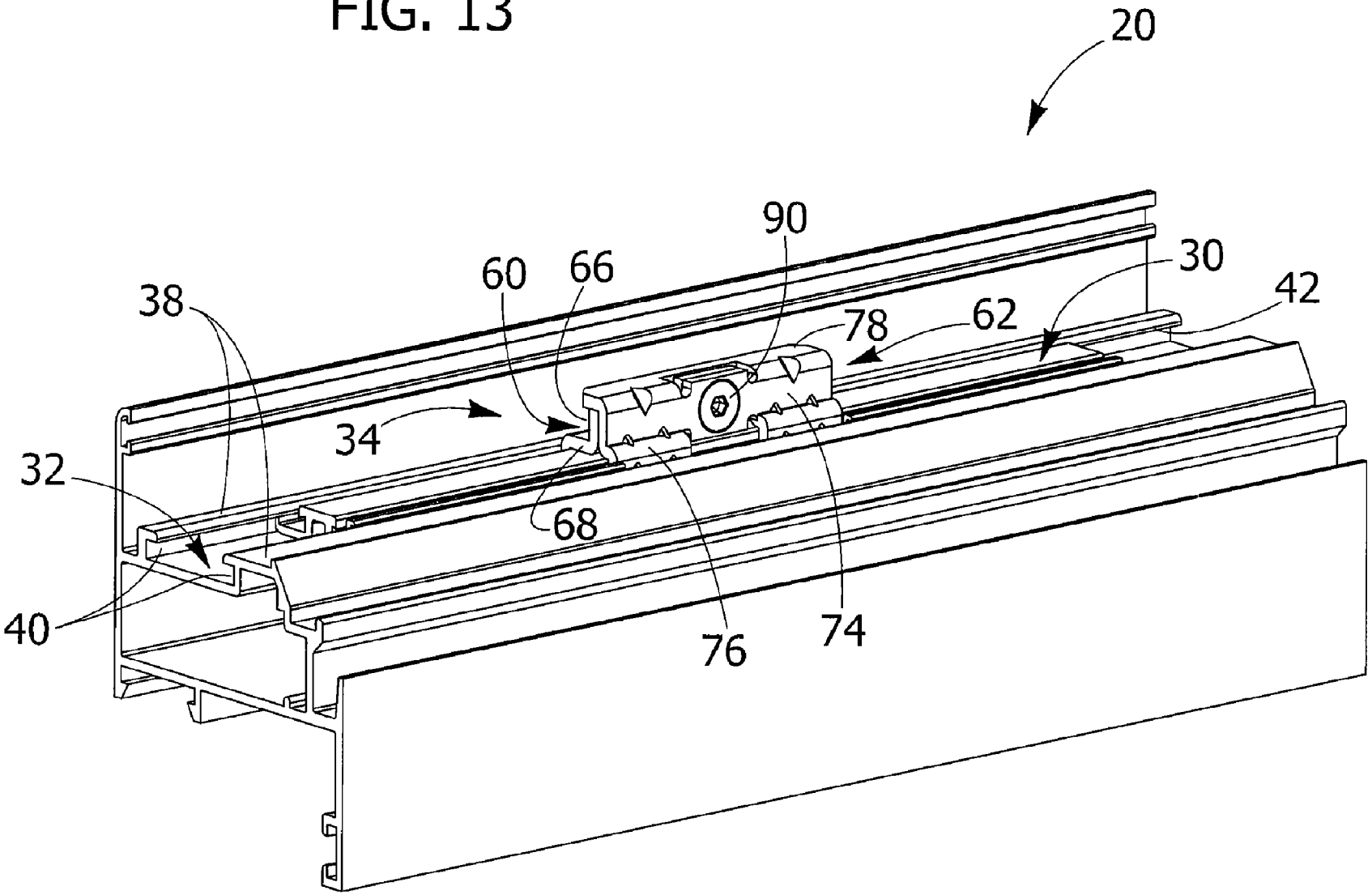

With reference to FIGS. 12 and 13, installation is completed by inserting a screw 90 into a hole 92 of the second part 62. As may be seen in FIG. 11, the hole 92 is shaped like a truncated cone and is aligned to the threaded hole 70 of the first part 60.

The screw 90 is screwed into the hole 70 of the first part 60.

As may be noted in particular in FIG. 11, in the assembled configuration, the engagement element has two tenons 72, 64, which engages the two undercut portions 40 of the longitudinal groove 32 of the sectional element 20. The engagement element 34 is free to slide along the longitudinal groove 32 together with the transmission rod 30, to which the closing element 34 is fixed thanks to the engagement with the transverse edges of the openings 54, 56 of the transmission rod 30.

Figure 14:
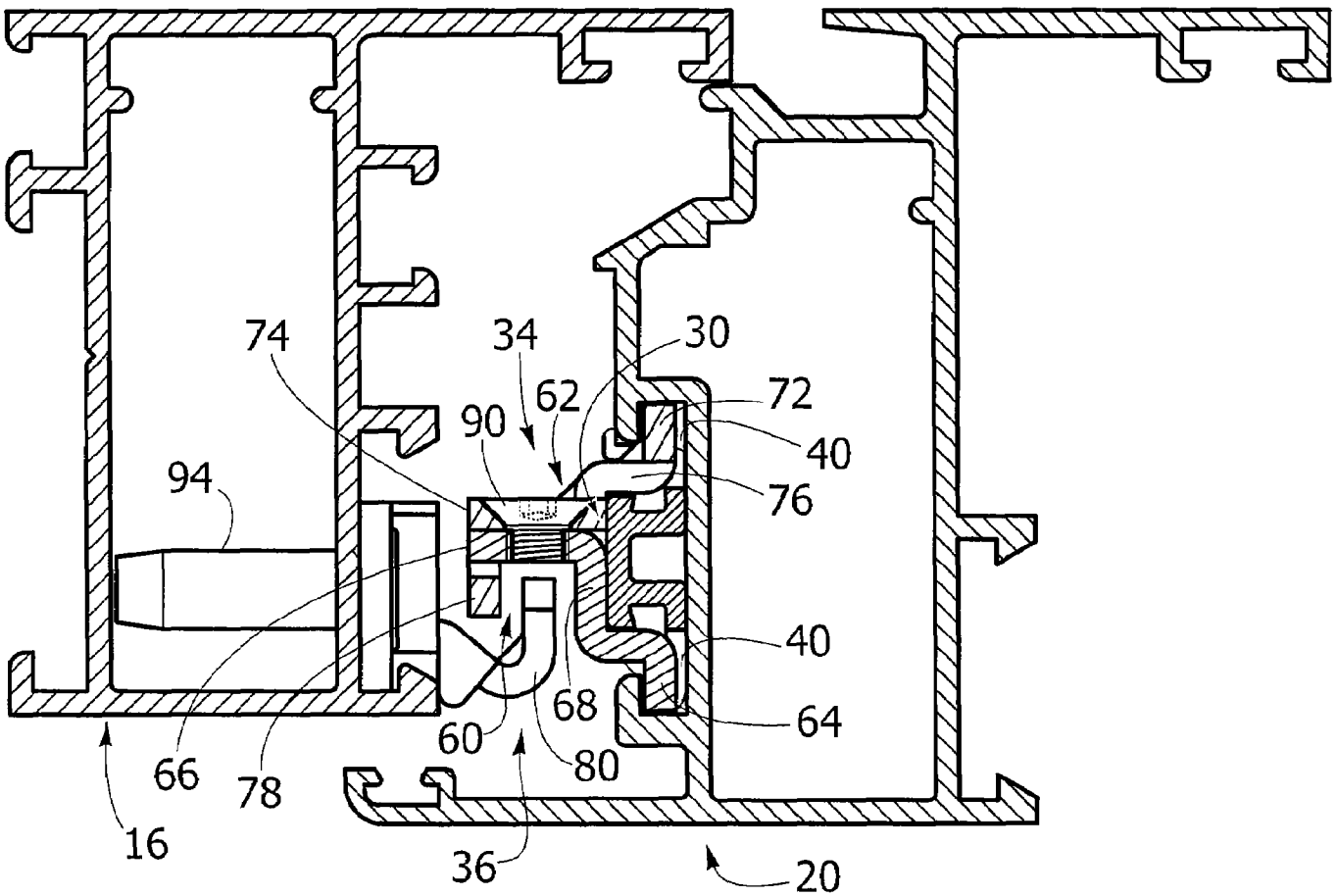
FIG. 14 is a cross-sectional view illustrating the safety system according to the invention in conditions of use.

With reference to FIG. 14, the detent 36 is fixed to the sectional element 16 of the fixed frame by means of screws 94. The closing element 34 moves in a longitudinal direction together with the transmission rod 30 between a position of engagement and a position of disengagement with respect to the detent 36. In the engagement condition, the engagement portion 78 of the closing element 34 faces, without coming into contact therewith, the corresponding engagement portion 80 of the detent 36. In this condition, any attempt at effraction tending to deform the sectional element 20 of the mobile frame inwards brings the engagement portions 78, 80 of the closing element 34 and of the detent 36 into mutual contact, which hinders any further deformation inwards of the mobile sectional element 20.

Each door or window frame can be provided with a plurality of anti-effraction closing systems according to the present invention distributed along the openable upright 20 and possibly along the cross members 22. Installation of the closing system according to the invention is particularly simple given that the closing element 34 is mounted in the groove 32 in a front direction. It is hence not necessary to take down the accessories already installed on the door or window frame. This characteristic enables installation of the anti-effraction safety system also with the door or window frame already mounted in place, provided that the transmission rod 30 is equipped with the openings 54, 56 as described previously.

While the foregoing is directed to embodiments of the present invention, other and further embodiments of the invention may be devised without departing from the basic scope thereof, and the scope thereof is determined by the claims that follow.

The invention claimed is:

1. An anti-effraction safety system for a door or window frame comprising a fixed frame and a mobile frame, in which the mobile frame comprises at least one sectional element with a longitudinal groove with two undercut portions set on opposite sides of a longitudinal central opening and in which at least one transmission rod slidably engages said groove and can be displaced in a longitudinal direction by means of a control handle, and in which fixed to said transmission rod is at least one closing element co-operating with a complementary detent fixed to said fixed frame, wherein said transmission rod has two through openings both open on respective longitudinal edges of the rod, and wherein said closing element comprises two separate complementary parts fixed to one another, in which each of said separate parts engages a respective through opening of the transmission rod and has a respective tenon that slidably engages in a longitudinal direction a respective undercut portion of the groove.

2. The safety system according to claim 1, wherein each of said parts of the closing element comprises a respective fixing portion fixed to the fixing portion of the complementary part by means of a screw.

3. The closing system according to claim 1, wherein each of said parts of the closing element is formed by a monolithic piece of stamped or bent metal plate.

4. The closing system according to claim 1, wherein at least one of said parts is provided with a bent edge forming an engagement portion.

5. The closing system according to claim 1, wherein the engagement element is fixed to the transmission rod as a result of the engagement of said parts of the closing element with the edges of said through openings made on the transmission rod.

* * * * *